US006237361B1

(12) United States Patent
Broussard

(10) Patent No.: US 6,237,361 B1
(45) Date of Patent: May 29, 2001

(54) COLLAPSIBLE COLD STORAGE SYSTEM

(76) Inventor: Ken Broussard, 6730 Gulfway, Port Arthur, TX (US) 77642

( * ) Notice: Subject to any disclaimer, the term of this patent is extended or adjusted under 35 U.S.C. 154(b) by 0 days.

(21) Appl. No.: 09/441,469

(22) Filed: Nov. 17, 1999

(51) Int. Cl.[7] ..... F17C 13/00; F25B 21/00
(52) U.S. Cl. ..... 62/457.9; 62/371; 62/237
(58) Field of Search ..... 62/371, 237, 457.9

(56) References Cited

U.S. PATENT DOCUMENTS 3,477,243 * 11/1969 Schroeder et al. ..... 62/237
5,285,657 * 2/1994 Bacchi et al. ..... 62/457.9
5,671,611 * 9/1997 Quigley ..... 62/457.7
5,918,478 * 7/1999 Bostic et al. ..... 62/371
5,943,876 * 8/1999 Meyer et al. ..... 62/371
6,065,294 * 7/2000 Hammerstedt et al. ..... 62/3.3
6,092,381 * 7/2000 Hsiao et al. ..... 62/237

* cited by examiner

*Primary Examiner*—William Doerrler
*Assistant Examiner*—Mark Shulman
(74) *Attorney, Agent, or Firm*—Bracewell & Patterson, L.L.P.

(57) ABSTRACT

A palletized cooling system for shipping goods at controlled temperature and which includes a self powered cooling box and a plurality of storage boxes. Coolant is circulated by means of coolant outlet and return lines from the cooling box to each of the storage boxes thereby maintaining the interiors of the storage boxes at a specified temperature. The cooling and storage boxes are dimensionally identical, and can be abuttingly stacked for optimal use of cargo space. Storage boxes can be folded when not in use thereby also optimizing storage and shipping space.

16 Claims, 4 Drawing Sheets

FIG. 1
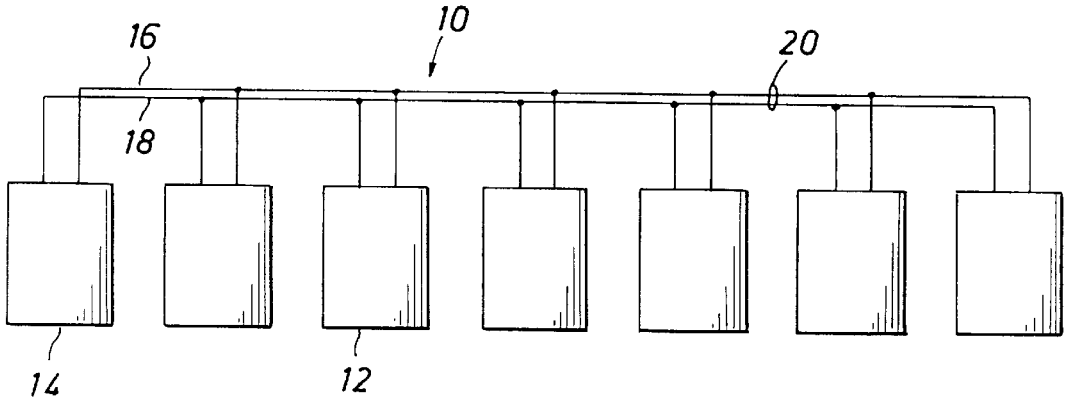
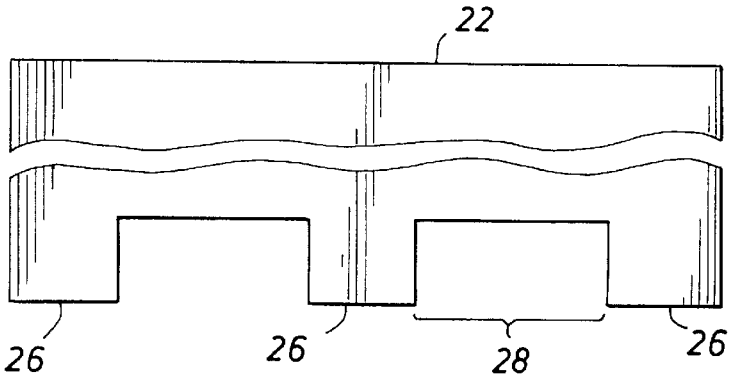
FIG. 3
FIG. 2
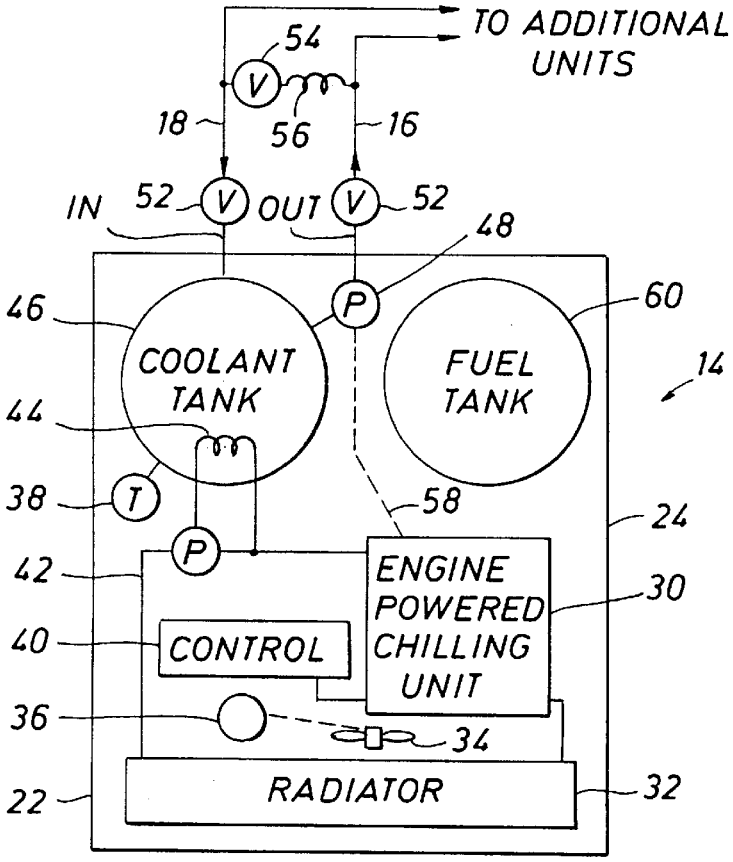

FIG. 4
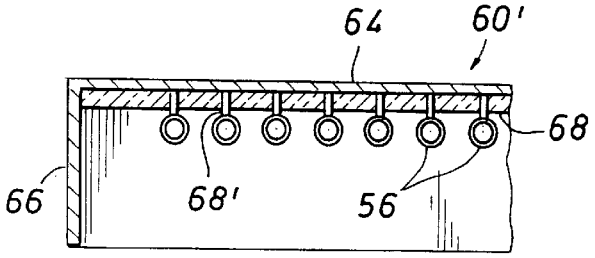
FIG. 5
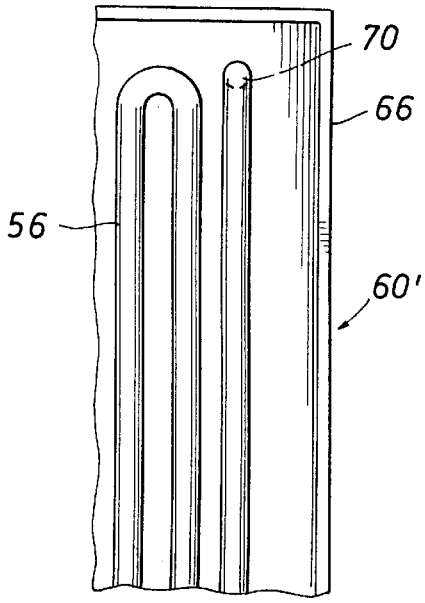
FIG. 6
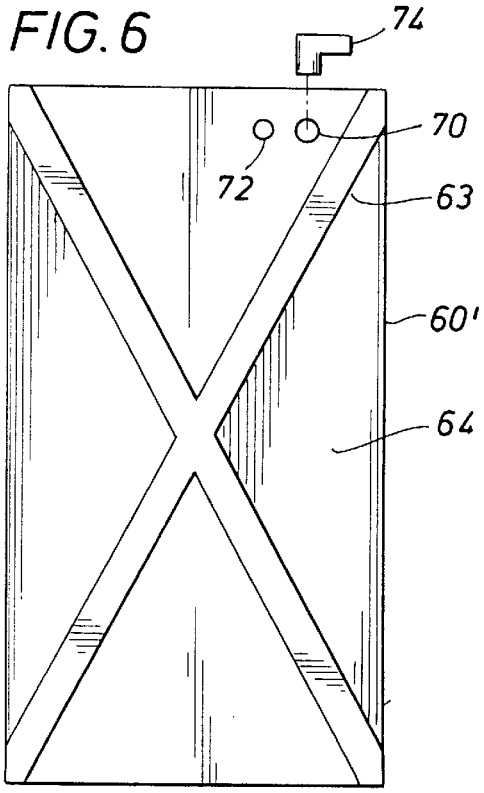
FIG. 9
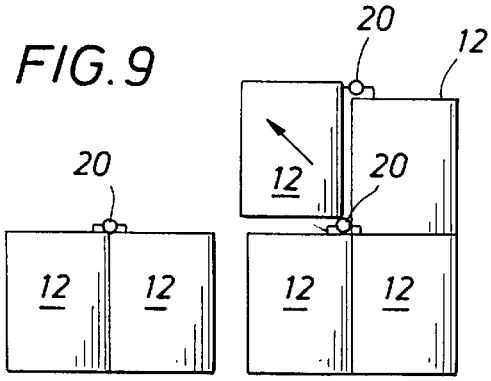
FIG. 8
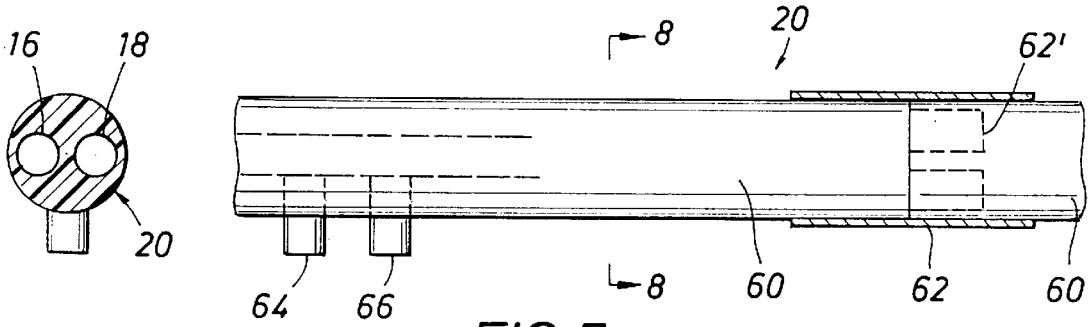
FIG. 7

FIG. 10a
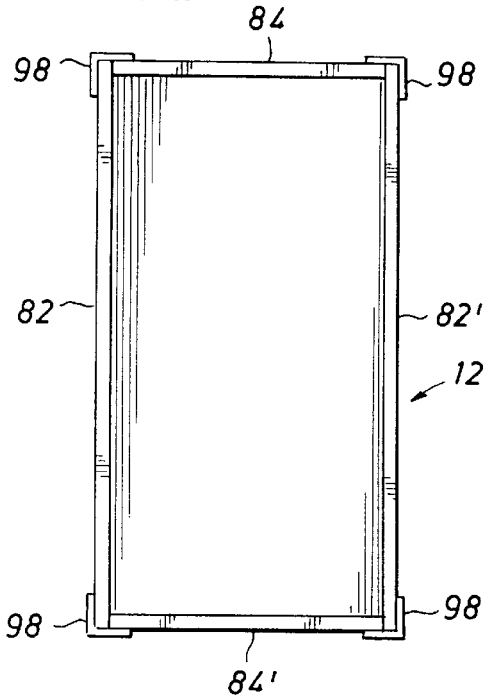
FIG. 10b
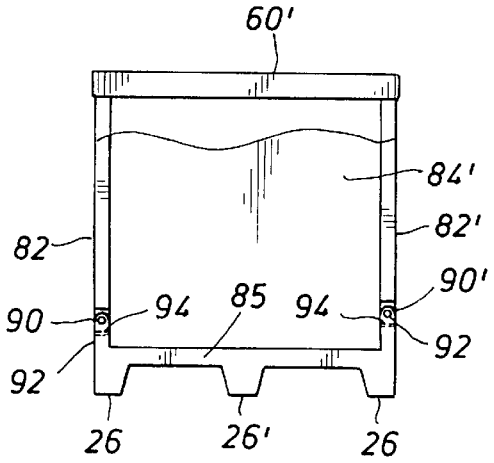
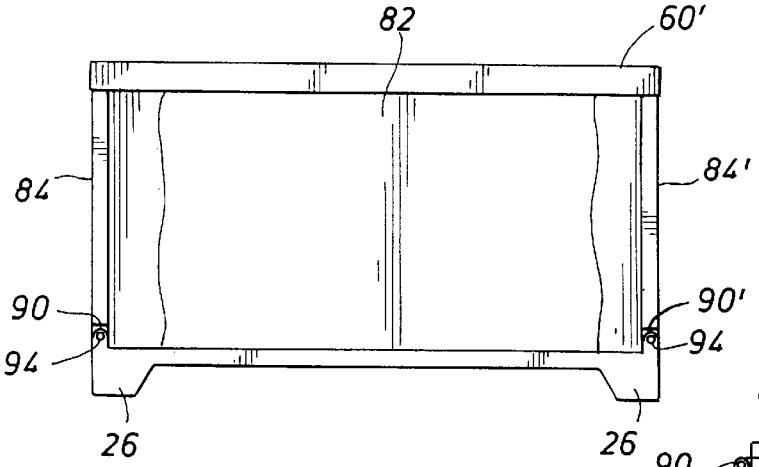
FIG. 10c
FIG. 11b
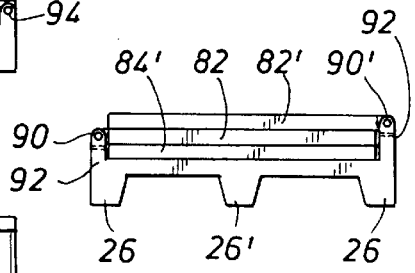
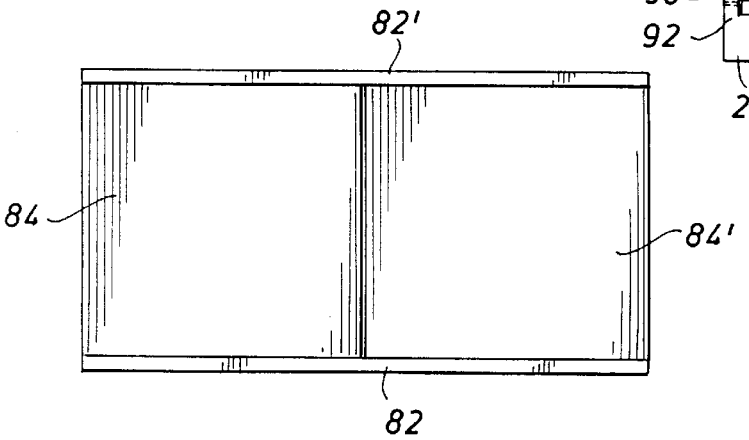
FIG. 11a

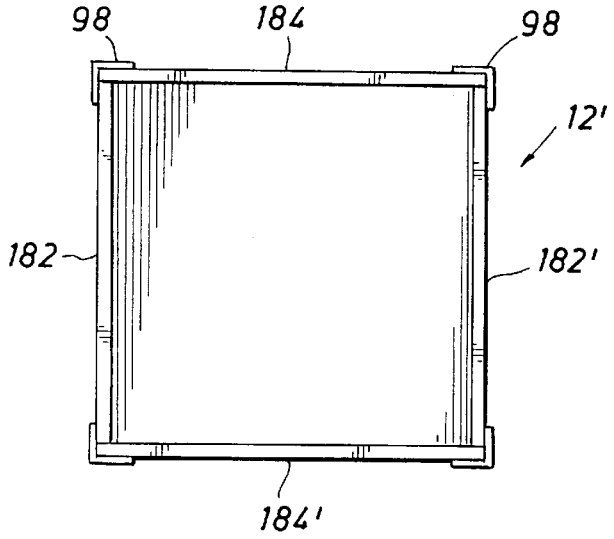
FIG. 12a
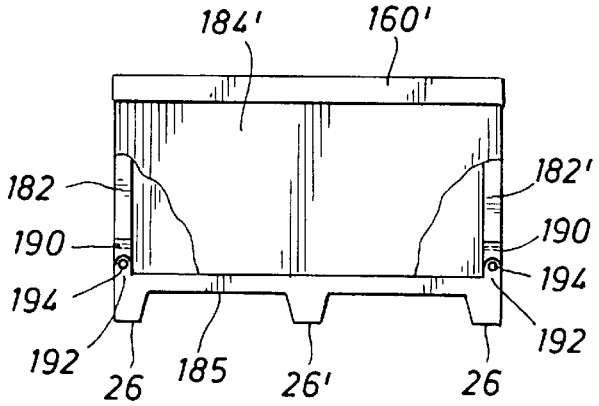
FIG. 12b
FIG. 12c
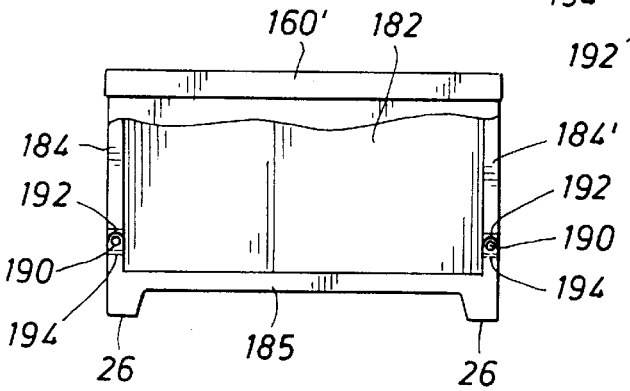
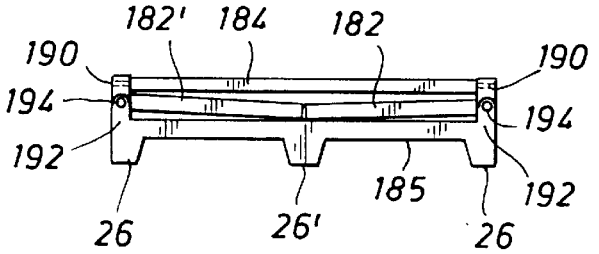
FIG. 13b
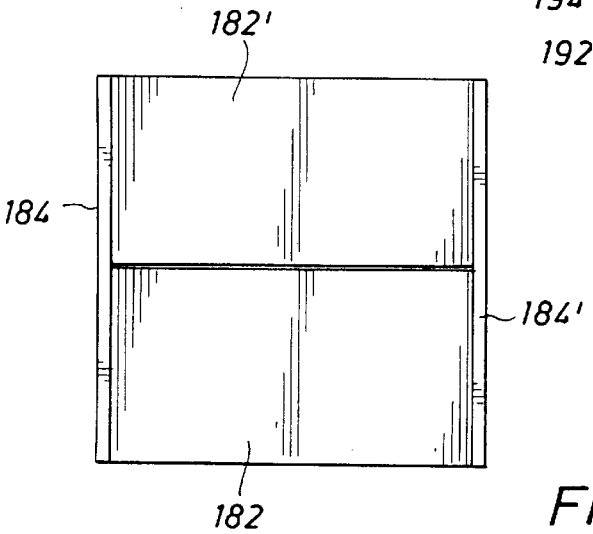
FIG. 13a

COLLAPSIBLE COLD STORAGE SYSTEM

BACKGROUND OF THE DISCLOSURE

This disclosure is directed to a palletized cooling system as set forth. In particular, it is a cooling system which requires no power when shipped on board a train, on a flat car, on a flat bed trailer of a truck, or on ship board. All that is required for the operation of this equipment is ventilation so that fresh air can circulate. The air circulation is provided so that continued cooling is accomplished through the operation of a refrigeration system. This cooling method is effective to chill and maintain the static temperature for cold goods. It involves a multiple unit set of replicated storage boxes. One box, preferably having a common profile with all of the others, incorporates a power plant with cooling system.

The cooling system is connected to the cargo boxes with an external hose. The hose extends from the cooling box (that term will be applied to the power plant) and comprises branching conduits which connect to the cargo boxes. Each cargo box is preferably identical to all of the others. All of the boxes have a common foot print<. The footprint can be either square or rectangular. If square, the sides are preferably four feet in length. These dimensions are conformed with the foot print of a "standard" pallet. The bottom panel of each box is preferably provided with at least at least one leg or "foot" at thereby elevating the bottom above a surface upon which the box rests for ease of lifting. The bottom panel is optionally provided with fifth and sixth legs thereby enabling tines of a forklift to be controllably inserted under the box for lifting. All of the boxes are provided with common dimensions on the bottom so that they can be either be stacked vertically or arranged horizontally. When empty, the boxes can be collapsed by folding sides thereby reducing the height of each box and significantly reducing storage space required to store empty boxes.

The cargo boxes are externally connected with a hose network which is rather simple to install and remove. The hose network can be extended in length. By adding different increments, the number of cargo boxes connected to the system can be increased to any suitable number N, where N is a whole number positive integer. In terms of cooling capacity, N is practically limited depending on the heat loss encountered in transit. In turn, that typically depends on the ambient temperature in the trailer or cargo hold of the vessel, and that in turn is dependent on the temperature differential maintained in the cargo box. The system operates at temperatures below freezing, if desired. Again, that depends on the amount of energy required to drop the temperature. It preferably operates with a flowing coolant which is chilled to some desired temperature level. For instance, many products can be shipped where it is maintained at about 35° to 40° F. The system, however, will also operate by circulating a coolant which is chilled below freezing so that items which are prefrozen in water (fish is one example) are maintained at that cold temperature. In general terms, the cooling system of the present disclosure maintains the frozen cargo at a desired temperature somewhere in the range of about 15° F. at the low end to about 40° F. at the high end. This range is merely representative, however, and the range can be extended further by the choice of different cooling liquids which are circulated in the system.

In the present disclosure, the cargo boxes are constructed so that they have a removable lid. The lid is positioned parallel to the base, as that term will be applied to the bottom side portion. The base has at least four legs on it, and preferably six legs. The six legs are deployed to define spaces between the legs. These spaces enable the insertion of the tines of a forklift to raise and lower the cargo box. The base is constructed as a bottom platform having fixed base dimensions. The fixed dimensions conform with the desired industry standard footprint which enables the devices to be loaded on a forklift and to be supported in the form of a pallet. In this instance, a disposable pallet is avoided and can be omitted because the base is itself pallet conformed. The base supports four walls which are upstanding walls defining the cargo box. The four walls are comprised of two long walls and two short walls, or alternately four walls of the same length. The four walls all hinge and fold to assemble in a shortened or compact structure. When folded, the four walls stack in a fashion enabling the box to be reduced in height so that the empty box, in a return trip, is easier to return. In effect, the return trip of the empty box is accomplished without shipping the box fully assembled. The sides fold down to thereby shorten the height. Approximately, the entire unit is shortened by about 60% to 70%, depending on specific dimensions of the box. The return trip, therefore enables approximately four, five, or six units to be stacked vertically in a location where only two units could have been stacked vertically while fully erect.

This box type construction with folding sides enables the cargo to be delivered and removed from the boxes. Then on the return trip, the boxes are simply stacked.

Each box is provided with its own lid. The lid is constructed with a surrounding lip, an adjacent internal seal ring, and an internally supported heat exchanger. The heat exchanger is in the lid. It is placed high up in the lid so that it is protected by the surrounding lid lip. It is mounted on the inside of the lid by suitable spaced hangers. The heat exchanger has the form of a repetitive coil of flat shape. It terminates at a pair of fittings which extend through the lid. This enables inlet and outlet connections to be accomplished. The connections are preferably side by side so that the inlet and outlet connections on a string of these cargo boxes are easily accomplished with a common pair of fluid flow lines. One is the delivery line, and the other is the return line. They are preferably provided with suitable fittings to assure that there is no confusion in connection.

The cooling system of the present disclosure is especially effective for shipping chilled or frozen items where the transport requires several days. It cooperates with a self contained cooling system. It is provided with a control which is adjusted so that the coolant circulated by the system is capable of sustaining a fixed temperature throughout the trip, voyage, or storage interval. To this end, the system utilizes a commonly connected external hose, really a pair of hoses, which are assembled in repetitive fashion for connection to the source of the chilled refrigerant.

SUMMARY OF THE PRESENT DISCLOSURE

The present invention is summarized as a system formed by one cooling box which is connected to provide chilled flowing liquid to a plurality of cargo boxes. All of the boxes have a common size and shape. And from the exterior, all of the boxes have a common appearance. All of the boxes are handled with an integrated pallet at the bottom and all of the boxes are commonly deployed so that a single hose is connected from box to box. The box enclosing the cooling equipment has an engine powered chilling unit with a conventional dual phase refrigerant cycle. It chills water or some other flowing liquid which is used as a cooling liquid to be recirculated in a pair of lines. One of the lines is an outlet and the other is an inlet, and the two lines are preferably deployed in a single or common insulated sleeve. By the use of conveniently located keyed connectors, the two lines are extended adjacent to the multiple cooling boxes, and are connected to them. Each cooling box comprises a pallet conformed based, four walls which optionally fold up or fold down, and which define a cargo space when folded up. The four walls are then covered with a lid. The lid is constructed with an external reinforcing frame, an internally located cooling coil, and externally extending dual connections to connect the cooling coil between the lines. This enables the chilled liquid to be delivered into each box to maintain each box at a reduced temperature.

BRIEF DESCRIPTION OF THE DRAWINGS

So that the manner in which the above recited features, advantages and objects of the present invention are attained can be understood in detail, more particular description of the invention, briefly summarized above, may be had by reference to the embodiments thereof which are illustrated in the appended drawings.

It is to be noted, however, that the appended drawings illustrate only typical embodiments of the invention and are therefore not to be considered limiting of its scope, for the invention may admit to other equally effective embodiments.

FIG. 1 a schematic representation of the cooling system of the present disclosure showing several cargo boxes which are connected to common inlet and outlet lines for cooling with a refrigerant delivered from a structure enclosing a cooling system;

FIG. 2 is a detailed view of the refrigerant source showing the common footprint to all of the boxes;

FIG. 3 is a side view of a cooling box showing the base thereof which is constructed in accordance with an industry standard to enable forklift loading as a pallet;

FIG. 4 is a sectional view through the lid showing a dual layer lid having an outer metal layer, and internal insulator layer, and a set of coils supported on the interior;

FIG. 5 is a bottom view of the lid shown in FIG. 4 showing the coils illustrated across the lid on the interior;

FIG. 6 is a plan view of the lid shown in FIGS. 4 and 5 illustrating a top mounted lid brace, and connections for the cooling coil illustrated in FIGS. 4 and 5;

FIG. 7 is a side view of a hose made of separate lengths repetitively linked together wherein the hose includes outlet and inlet lines for the refrigerant;

FIG. 8 is a sectional view taken along the line 8—8 of FIG. 7 showing internal construction of the hose;

FIG. 9 is a view of stacked boxes;

FIG. 10*a* is a top view of a box with a rectangular footprint and all sides vertically extended;

FIG. 10*b* is a short side view of a box with a rectangular footprint and all sides vertically extended;

FIG. 10*c* is a long side view of a box with a rectangular footprint with all sides vertically extended;

FIG. 11*a* is a top view of a box with a rectangular footprint with the short sides folded;

FIG. 11*b* is a short side end view of a box with a rectangular footprint with all sides folded for storage.

FIG. 12*a* is a top view of a box with a square footprint and all sides vertically extended;

FIG. 12*b* is a short side view of a box with a square footprint and all sides vertically extended;

FIG. 12*c* is a long side view of a box with a square footprint with all sides vertically extended;

FIG. 13*a* is a top view of a box with a square footprint with the one pair of sides folded; and FIG. 13*b* is a side end view of a box with a square footprint with all sides folded for storage.

DETAILED DESCRIPTION OF THE PREFERRED EMBODIMENTS

Attention is now directed to FIG. 1 of the drawings where the cooling system of the present disclosure is illustrated in very general terms. A functional relationship, as well as a physical relationship is implied in the system 10. It is viewed from above. It comprises a set of cargo boxes 12 which are positioned adjacent to a cooling box 14. The box 14 holds the cooling equipment to be discussed. The box 14 provides a cooled refrigerant which is circulated in two lines. The two lines are shown as separate lines in FIG. 1, but for convenience sake, they are enclosed in a single sleeve thereby comprising a single conduit, as will be discussed with regard to FIGS. 7 and 8. For functional explanation, however, FIG. 1 shows the lines 16 and 18. They are combined in the line 20 as a single unit. The line 16 is the coolant outlet line, while the line 18 is the return line (see also FIG. 2 of the drawings). The two lines 16 and 18, wrapped in a common single sleeve and identified at 20, are extended to a suitable length to chill the several boxes 12.

The cargo boxes 12 commonly are stacked either vertically or positioned side by side horizontally, they can be arranged in two adjacent rows. Alternately, the boxes 12 can arranged in four adjacent rows, two rows on the bottom, and two rows stacked on the bottom two rows. Then, in that instance, the lines 20 are positioned between the boxes as shown in FIG. 9. FIG. 9 shows several views where the boxes 12 with the hose connection on the outside of the boxes, indicates how a box can be removed, and takes advantage of nesting between the boxes. When nesting occurs, heat loss from the individual boxes is reduced. The box footprint is either rectangular or square, with the square embodiment preferably with folding sides four feet in length.

REFRIGERANT UNIT CONSTRUCTION

Attention is directed to FIG. 2 of the drawings. It shows the unit 14 in plan view with the top removed. It has a common footprint. This footprint is identified with the narrow dimension 22 and the longer dimension 24. The dimensions 22 and 24 are implemented by constructing these items in accordance with an industry standard. The same dimension is involved in the width of the cargo boxes shown in FIG. 3. There, the side view illustrates the feet or legs 26 which protrude to a common height from each corner of the base. Additional legs 26' are shown protruding from the base, thereby defining a gap 28, there being two such gaps so that the tines of a forklift can be securely inserted to lift the unit 14. It is handled by forklift. The boxes 12 are likewise handled by forklift.

Continuing with the refrigerant source 14 shown in FIG. 2, and noting that this is a plan view, the top has be deleted for illustration of the components. There is an engine powered chilling unit 30 which connects with a heat rejection radiator 32. Heat is blown out of the radiator either by a cooling fan 34 or by air convection currents. As needed, a motor 36 is operated to blow air through the radiator for cooling purposes. The motor 36 is subject to a control unit 40. The control unit 40 also controls the chilling or refrigeration unit 30. To this end, the control 40 is provided with an input signal from a thermostat 38 which is connected to the coolant tank to be described.

A typical refrigerant is circulated through a flow line 42. It is delivered to a cooling coil 44 inside a coolant tank 46. The coolant tank holds a chilled liquid which is delivered through the outlet line 16. There is a pump 48 for that delivery. A fuel tank 50 is also illustrated to provide adequate fuel for the engine powered chilling unit 30. The refrigerant in the flow line 42 can be a typical FREON™ based refrigerant (FREON is a trademark of the DuPont firm) which is the conventional and well known refrigerant for use of this purpose. Alternatives also include ammonia and other refrigerants. In common usage, this type refrigerant is pumped through a refrigeration cycle wherein it is compressed by the chilling unit, heat is surrendered in the radiator, and the compressed refrigerant is converted from a gas into a cooled liquid. The cooled liquid is delivered to the coil 44 at which location it is permitted to expand. When it expands, the expansion drops the temperature in the coolant tank 46. The coil 44 is normally submerged in the liquid in the cooling tank. There are, however, difficulties in making connections for that refrigerant. Accordingly, it is therefore more practical to use a less demanding line connection to the various cargo boxes 12. For that reason, the refrigerant is confined to the flow line 42 and the coil 44 and is then recirculated. As will be understood, the conventional refrigerant equipment is utilized for the engine powered chilling unit 30, the radiator 32 and recirculation from the coil 44. Effectively, the coil 44 corresponds to an evaporator coil in a typical refrigeration cooling system.

The coolant tank is a reservoir of some cooling fluid. Salt water will suffice. Otherwise, fresh water can be used provided it is not chilled below freezing. To lower the freezing temperature, various mixtures of alcohol and other antifreeze agents are known, and they can be added in the coolant tank 46. Ethylene glycol can be added to drop the freezing temperature permitted for the coolant in the tank 46. Assume, for instance, that the boxes 12 are chilled to some temperature above 32° F. Water will suffice for that system. If a temperature less than that is required, then the water has to be mixed with alcohol or ethylene glycol as appropriate. It is desirable that the water be also protected by adding trace surface corrosion materials. The lines 16 and 18 can be made of alternative materials to reduce corrosion.

As illustrated, there are various check valves 52 which are incorporated in the system. Another check valve is shown at 54. It is a valve which is ideally located in the lids 60' for the cargo boxes 12. In addition, it works with a heat transfer coil 56. The check valve 54 and the coil 56 will be described in detail with regard to one of the box lids as detailed more particularly in FIGS. 4, 5, and 6. Assume that the number of cooling boxes is 10 so that N is given by that number. Assume also that each box in a worst case analysis requires 4,000 BTU of heat removal per hour. In effect, with 10 boxes, that means that 40,000 BTU per hour cooling capacity is required. Such a system can readily operate for 10 to 20 days with an adequate fuel supply 50. Such a system is controlled in operation by making due note of the coolant temperature. By maintaining the tank 46 at the desired cold temperature, this assures that the pumped refrigerant delivered out through the line 16 and returned through the line 18 provides adequate cooling for all of the boxes 12. The system of the present disclosure is switched on by turning on the chilling unit 30 by delivering a feed of fuel from the tank 50 for its operation. In turn, it operates continuously. It is constructed with an. expansion valve which cooperates with the evaporator coil 44. This enables the chilling unit 30 to recirculate the refrigerant in the closed cycle flow path. Cooling occurs at the cooling tank 46 which is dropped to the desired temperature. The control 40 keeps up with the operative status.

Preferably, the engine powered chilling unit is provided with a power take off (PTO) 58 which connects to the pump 48 to power it. Conveniently, the PTO 58 can also be connected to the motor 36 to provide power for it. Otherwise, independent motors can be used in either instance. Continuing on with the description, this unit is enclosed, appears like all of the other units. 12, and is installed at a convenient location assuring that the radiator 32 is provided with adequate air flow. This assures that heat rejection is not interfered with.

Attention is now directed to FIGS. 7 and 8 of the drawings. The hose 20 is shown in greater detail. It is formed of individual hose segments 60. Several segments are abutted against each other. Two segments are joined by an external sleeve 62 which fits over the abutting end connections on a hose segment 60. The hose segment is provided with a bayonet type plug and socket 62' indicated in dotted line in FIG. 7. Each of the hose segments is provided with outlet connectors 64 and 66. The connectors 64 and 66 are keyed to the two individual lines 16 and 18. They are shown in better detail in FIG. 8. That shows in cross sectional view the lines 16 and 18. Preferably, the lines 16 and 18 are individual lines which are captured by the surrounding sleeve 20. The sleeve 20 is insulated. This slows heat loss. Moreover, the connections 64 and 66 which extend outwardly are deployed at a fixed spacing for easy connection. In other words, they conform with the connectors involved at the individual cooling boxes.

The two connectors 64 and 66 preferably operate in the same fashion, but they are uniquely coded to indicate that one is the inlet line and the other is the outlet line. If need be, they can be constructed with slightly different connectors. Or, they can constructed with markings on them. A fixed spacing between the two can be deployed against several of the boxes 12 so only one mode of connection is permitted. By doing this, reversal of connections is avoided. In actuality, reversal of the connections is not a great problem, but the key is uniformity in installation so that less training is required for the personnel to install and connect the hose 20. The hose 20, in turn, is extended so that it matches the length of a set of the boxes 12. Reverting for the moment to FIG. 1, the boxes 12 are shown spaced apart to bring out some aspect of the functional relationship, but in the preferred assembly for shipment in a cargo vessel, they are preferably abutted side to side or abuttingly stacked. This holds down the heat loss by assuring that common walls are adjacent so there is little heat loss through the two adjacent common walls. One advantage is brought out in the arrangement of the two boxes shown in FIG. 9, and the four boxes shown in another construction which illustrates abutted stacking. The connective lines necessary to interconnect the various components are shown.

Attention is now directly jointly to FIGS. 4, 5, and 6 for a description of the lid placed on a box. The discussion of the lid will be provided before going to the box construction, which is shown in FIG. 10 and following. This active component is pluming into the system. This is done so that the refrigerant which is delivered through the line 20 is circulated. An individual lid is therefore shown in FIG. 6 of the drawings and comprises a lid 60' conforming to the footprint of all of the boxes. This top or plan view of the lid 60' shows an externally located x-shaped reinforcing frame 63. This has the form of an x-shaped reinforcing frame on top of the lid. The lid itself is constructed of relatively thin top plating 64 also shown in FIG. 4. The lid is surrounded by a protruding lip 66. The lip 66 has a height sufficient to assure clamping when the box is installed with the lid.

The lip 66 is also shown as viewed from the bottom side. This is illustrated in particular in FIG. 5 of the drawings which shows the coil 56 suspended on spaced mounting members 68'. These are located at spaced locations to assure that the heat exchanger coil 56 is on the interior and below the lid so that it is able to circulate chilled water or other fluid, thereby providing cooling on the interior. Moreover, the lid is provided with an insulative layer 68 on the inside. The insulative layer 68 can typically be a sprayed resilient elastomeric material, or the like. Preferably, it spans the full interior surface area of the top plat 64 defining the lid 60'. At the edges adjacent to the lip 66, the insulation layer serves as a seal when contacted against the erected walls of the box. That will be discussed later.

The lip 66 has a height sufficient to assure a relatively safe connection with the box. Reference is made to closure of the box so that cooled items to do not readily escape. If the interior is filled with a liquid which is otherwise frozen to a solid form, that does not pose much of a problem. In some instances, it may be desirable that the boxes carry a liquid. In that event, it is desirable that the lip 66 has sufficient height, sufficient rigidity, and dimensional regularity so that a good seal is accomplished. More will be noted about sealing below. In any case, the lip 66 assures that product does not splash out. The lip has a height and sealing effect is along the lines just noted.

The cooling coil is deployed on the interior so that cooling is assured. The cooling coil, however, does not connect through the lip 66. As shown in FIG. 5, the cooling coil 56 terminates at a top located opening 70 also shown in FIG. 6. A companion opening is provided at 72. They are illustrated with different sizes, it being appreciated that different size connectors can be used. Only slight differences are required to assure that the connections are made properly. As previously noted, in a technical sense, this takes advantage of the sparse pluming arrangement, which uses very little transverse header connections from the main hose 20. It is desirable to reduce the length of lateral lines from the hose 20. Impart, this reduces heat loss, and it also reduced the complexity of the connections. More specifically, the openings 70 and 72 in the lid face upwardly. More commonly, the box will be stacked so that another unit will be placed on top of the lid 60' illustrated in FIG. 6. The x-shaped braces have a height defining a gap. This height enables an elbow 74 to be connected to the opening 70. This permits the elbow to connect to the outside of the box. This enables the line 20 to be extended along the edge of the box. Two such elbows are used, one for each of the two openings. The two elbows connect out for the line 20 and connect to the hose 20. When this accomplished, connections are easily made. They are also easily disconnected at the time of delivery of the cargo. Moreover, the cooling coil 56 which is located inside each lid then provides the heat transfer necessary to maintain the cargo at the desired cold condition.

As mentioned previously, the footprint of the box can be rectangular or square. These embodiments of the invention are specifically disclosed in the following sections.

BOX WITH RECTANGULAR FOOTPRINT

FIGS. 10*a*, 10*b* and 10*c* illustrate a box 12 with a rectangular footprint and comprising a lid 60', a bottom 85, long sides 82 and 82' and short sides 84 and 84' in an upright position ready for use and cooling. FIG. 10*a* is a top view of the box 12 with the lid 60' not shown. The sides 82, 82', 84, and 84' are clamped with suitable clamping means 98. FIG. 10*b* shows an end view of the box 12, again with all sides in an upright or extended position for use. The bottom legs 26 and 26' are again shown extending from the bottom 85. Upright extensions 92 at the corners of the bottom are also shown and serve as holders for pivot pins used to collapse the sides of the box when the box is not in use. The short side 84' is pivoted about pivot pins 94. The other short side 84 is pivoted in an identical manner. Long side 82' is pivoted about pivot pins 90' (also see FIG. 10*c*), and long side 82 is pivoted about pivot pins 90. Pivot pins 90' are elevated above pins 90 by a distance equal to the thickness of the side 82 for reasons that will soon be apparent. FIG. 10*c* shows a long side view of the box 12 with all sides vertically, with the long side 82 being cut away to clearly show the positioning of the short sides 84 and 84' with respect to the extensions 92 and pivot pins 90, 90' and 94.

FIG. 11*a* is a top view of the box 12 showing the two short sides 84 and 84' folded down, while the long sides 82 and 82' remain upright. The dimensions of the short side are selected so that they do not overlap when folded, and preferably abut, as shown. FIG. 11*b* shows a short side end view with all sides folded down so that the box 12 occupies minimum space when not in use. Note that the elevated pivot pin 90' with respect to the pivot pin 90 allows the long sides 82 and 82' to overlay flatly thereby further minimizing storage space when the box is not in use.

BOX WITH SQUARE FOOTPRINT

FIGS. 12*a*, 12*b* and 12*c* illustrate a box 12' with a square footprint and comprising a lid 160', a bottom 185, opposing sides 182 and 182' and opposing sides 184 and 184' of equal length and in an upright position ready for use and cooling. FIG. 10*a* is a top view of the box 12 with the lid 160' not shown. The sides 182, 182', 184, and 184' are clamped with suitable clamping means 98. FIG. 12*b* shows a side view of the box 12', again with all sides in an upright or extended position for use but with the side 184' cut away to show the edges if the sides 182 and 182'. The bottom legs 26 and 26' are again shown extending from the bottom 185. Upright extensions 192 at the corners of the bottom are also shown and serve as holders for pivot pins used to collapse the sides of the box when the box is not in use. The opposing sides 184 and 184' are pivoted about pivot pins 190 within the extensions 192. The other opposing sides 182 and 182' are pivoted about pivot pins 194 within the extensions 192. FIG. 12*c* is also a side view of the box 12' which has been rotated 90 degrees from the view in FIG. 12*b* to more clearly illustrate the pivot pin arrangement.

FIG. 13*a* is a top view of the box 12' showing the two opposing sides 182 and 182' folded down, while the opposing sides 184 and 184' remain upright. The dimensions of the sides are selected so that they do not overlap when folded, and preferably abut, as shown. FIG. 13*b* shows an end view with all sides folded down so that the box 12' occupies minimum space when not in use.

BOXES WITH OTHER FOOTPRINTS AND HEIGHTS

The foregoing has been used to illustrate storage boxes embodied with rectangular and square footprints and with sides of heights illustrated in the examples. it should be understood that the height of the sides can be varied with respect to the dimensions of the footprint using additional pivot pin arrangements and still obtain a storage box which can be folded to reduce the height of the box when the box is not in use.

While the foregoing is directed to the preferred embodiment, the scope thereof is determined by the claims which follow.

What is claimed is:

1. A portable cold storage system comprising:

(a) a coolant box which cools and circulates a coolant liquid;

(b) a plurality of storage boxes, each of the storage boxes defining a bottom;

(c) a coolant outlet line and a coolant return line connecting each of said storage boxes with said coolant box thereby providing a conduit for said coolant liquid to circulate from said coolant box and through each said storage box and back to said coolant box thereby maintaining interiors of said storage boxes at a specified temperature; and (d) said bottom of each said storage box including feet which protrude downward to a common height thereby defining at least two gaps so that the tines of a forklift can be inserted under said storage box.

2. The system of claim 1 wherein:

(a) each said storage box comprises the bottom, and further comprises four sides and a top; and (b) said four sides can be folded flat with said bottom thereby conserving space when said box is not in use.

3. The system of claim 2 wherein each said top of each said storage box comprises:

(a) a cooling coil comprising an inlet end and an outlet end;

(b) an inlet connector connecting with said inlet end and extending through said top to removably connect with said coolant outlet line; and (c) an outlet connector connecting with said outlet end and extending through said top to removably connect with said coolant return line.

4. The system of claim 2 wherein each of said plurality of storage boxes is dimensionally identical.

5. The system of claim 4 further comprising:

(a) a single insulative sleeve which contains said coolant outlet line and said coolant return line; and (b) coolant inlet and outlet connectors spaced at intervals along said coolant outlet line and said coolant return line to align with said storage box inlet connectors and said storage box outlet connectors when said storage boxes are abuttingly stacked.

6. The system of claim 5 wherein said coolant outlet line and said coolant return line and said surrounding insulative sleeve are fabricated in sections which removably join with bayonet plugs and sockets to allow sizing connection to an abutted stack of storage boxes.

7. The system of claim 2 wherein each said top further comprises insulating material adjacent to said coil.

8. The system of claim 1 wherein said cooling box comprises:

(a) an engine powered chilling unit;

(b) a coolant tank containing said coolant which is cooled by said chilling unit; and (c) a circulating pump to circulate cooling liquid from said coolant tank and through said coolant outlet line and through said storage boxes and through said coolant return line and back to said coolant tank.

9. The system of claim 8 wherein said cooling box further comprises:

(a) a fuel tank to provide fuel for said engine powered chilling unit; and (b) a heat exchange system to vent heat from the operation of said chilling unit.

10. The system of claim 9 wherein said cooling box is dimensionally identical to said storage boxes.

11. The system of claim 2 wherein said bottom is rectangular.

12. The system of claim 2 wherein said bottom is square.

13. A storage box for maintaining material within a specified temperature, the storage box comprising:

(a) a bottom, four sides and a top configured in a rectangular shape, wherein said bottom includes feet which protrude downward to a common height thereby defining at least two gaps so that the tines of a forklift can be inserted under said storage box;

(b) a cooling coil within said top with an outlet and an inlet through which coolant is circulated to maintain said specified temperature; and wherein (c) said top can be removed and said four sides can be folded flat with said bottom thereby conserving space when said box is not in use.

14. The storage box of claim 12 wherein the footprint of said box is standardized to marine and rail and trucking shipping dimensions.

15. The storage box of claim 13 wherein said top comprises a cross brace thereby providing room to connect said outlet and said inlet with a source of circulating coolant when multiple storage boxes are abuttingly stacked.

16. The storage box of claim 13 wherein said top further comprises insulating material adjacent to said coil.

* * * * *